United States Patent [19]

Kurita et al.

[11] 4,361,327

[45] Nov. 30, 1982

[54] TOY HAVING A SPLIT MOVABLE MEMBER

[75] Inventors: Toshiaki Kurita, Torrance, Calif.; Masanori Mizunuma, Tokyo, Japan

[73] Assignee: Tomy Kogyo Company, Inc., Tokyo, Japan

[21] Appl. No.: 242,974

[22] Filed: Mar. 12, 1981

[30] Foreign Application Priority Data

Apr. 11, 1980 [JP] Japan ..... 55-49192

[51] Int. Cl.[3] ..... A63F 7/02

[52] U.S. Cl. ..... 273/119 R; 434/258

[58] Field of Search ..... 273/1 G, 1 E, 85 F, 273/108, 109, 110, 111, 113, 115, 116, 119 R, 121 R, 122 R, 129 R, 129 Q, 129 W; 434/258

[56] References Cited

U.S. PATENT DOCUMENTS

| | | | |
|---|---|---|---|
| 1,595,071 | 8/1926 | Carlson | 273/110 |
| 2,207,190 | 7/1940 | Carnahan | 434/258 |
| 2,960,339 | 11/1960 | Bush | 273/119 R |
| 3,647,212 | 3/1972 | Barlow et al. | 273/129 W X |
| 3,718,331 | 2/1973 | Scott | 273/119 R |
| 3,720,412 | 3/1973 | Ramirez | 273/110 X |
| 3,721,440 | 3/1973 | Burns | 434/258 X |
| 3,765,678 | 10/1973 | Greaney | 273/119 R |
| 3,837,095 | 9/1974 | O'Hara | 434/258 |
| 4,082,268 | 4/1978 | Breslow et al. | 273/113 X |

*Primary Examiner*—Richard T. Stouffer

*Attorney, Agent, or Firm*—K. H. Boswell; Edward D. O'Brian

[57] ABSTRACT

A toy that includes a housing having at least one object which is movably located in the housing. Also located in the housing is an object moving member which is a composite of two sections. The sections of this moving member are each individually movable with respect to one another and each independently movable with respect to the housing. This individual movement of the sections allows them to move into a cooperative position with respect to one another. When the sections are located in the cooperative position and maintained in the cooperative position by coordinating the individual movements of the sections, it is possible to locate the object on the object moving member and move the object from a first point in the housing to a second point in the housing. Movement of the object can be maintained as long as the sections are maintained in a cooperative position, however, if the sections are allowed to deviate from the cooperative position by not coordinating the movement of the sections, the object will become dislodged from the object moving member.

11 Claims, 7 Drawing Figures

10
12
14
16
20
22
24
26
28
30
32
34
36
38
40
42
44
46
48
50
52
54
56
58
60
62
64
66
68
70
72
74
76
78
80
86
88
90
92
94
96
98
100
102
104
106
108
110
112
114

TOY HAVING A SPLIT MOVABLE MEMBER

BACKGROUND OF THE INVENTION

This invention is directed to a toy wherein at least one object is housed within a housing and also is included within the housing is an object moving means. The object moving means includes two sections which are independently movable with respect to each other and with the housing and which are capable of assuming a cooperative position. When the sections are in their cooperative position, it is possible to move the object within the housing via the object moving means.

A plurality of games are known wherein a small spherical object, normally a metallic sphere, is moved within the housing. These games range from sophisticated pinball games to simple hand held games having plastic housings. Normally, these types of games include a spring activated plunger which will launch the object to an elevated position and the object then can roll under the influence of gravity across a playing surface to a lower position and hopefully be captured in a target or other means during its travel from the elevated to the lower position. These types of games are also augmented by incorporating flippers, bumpers and etc., to also move the object across the playing surface as it descends from the high elevation point to the low elevation point. The bumpers, flippers, etc., found on these types of games are normally unified structures which strike and propell the ball away from the bumper, flipper, etc.

In all of the above noted games, the object is generally only moved against gravity during the initial thrust under the influence of the launcher, plunger, etc., or when being activated on in a forceful manner by a bumper, flipper, etc. None of the above noted games utilizes movement of the object against the force of gravity up an inclined surface or even on a level surface wherein the object is moved in a slow precise manner by a movable bumper, flipper, etc. For such a hypothetical game, mentioned in the preceding sentence, the object would be moved at a much slower controlled rate. This would require a more detailed concentration on the part of the player to move the object at such a controlled rate. It is considered that such a game which required this expenditure of concentration would serve both from a play standpoint and would also serve to develop eye-hand coordination for tasks which require such coordination.

BRIEF DESCRIPTION OF THE INVENTION

In view of the above, it is considered that there exists a need for new and improved toys wherein an object is moved along a playing surface in a slow controlled manner. It is a broad object of this invention to fulfill this need. Additionally it is a further object of this invention to provide a toy which is economical to manufacture and thus economical to the consumer. Further it is an object to provide a toy which is simple in construction and use and therefore would find an audience among a large diversity of age groups.

These and other objects, as will become evident from the remainder of this specification, are achieved in a toy which comprises: a housing; at least one object movably located in said housing; an object moving means located in said housing, said object moving means having at least two sections, said sections movable with respect to each other and each independently movable with respect to said housing; means located in said housing for independently moving each of said sections of said object moving means in said housing; said sections having a cooperative position with respect to each other and said section being movable within said housing in said cooperative position by coordinating the independent movement of said section with respect to one another, said object moving means capable of moving said object in said housing from a first point to a second point when said sections are in said cooperative position and are maintained in said cooperative position by coordinating said independent movement of said section with respect to one another.

In the preferred embodiment of the toy the housing would include a playing surface located therein. The object moving means would be slidably mounted on this surface and as it moved over the playing surface it would be capable of moving the object from a first position to a second position on the playing surface. Further, a target means would be located at the second position on the playing surface. Additionally the toy preferredly would include a plurality of objects allowing the user of the game to play against himself or against another to see who could achieve the movement of the largest amount of objects from the first position on the playing surface to the target means.

In the preferred embodiment an object storage means and an object launching means would be located beneath the playing surface. Any of the plurality of objects after being deposited in the target means would become located in the storage means. From the storage means the objects would be conveyed by the launching means through a second opening to place them in position for movement by the object moving means.

In the preferred embodiment the individual sections of the object moving means, each would incude one-half of an object depository located thereon. Together the two halves of the object depository located on the individual sections would form a surface capable of holding the object in a manner such that the object could be moved toward the target means. If the two sections were moved at different rates, such that their movements were not coordinated and the sections did not assume their cooperative position, the two halves of the depository means would be separated and the object would no longer be maintained in one half or the other of the object depository causing the object to roll away from the object moving means and become out of play.

BRIEF DESCRIPTION OF THE DRAWINGS

The invention described in this specification will be better understood when taken in conjunction with the drawings wherein.

Figure 1:
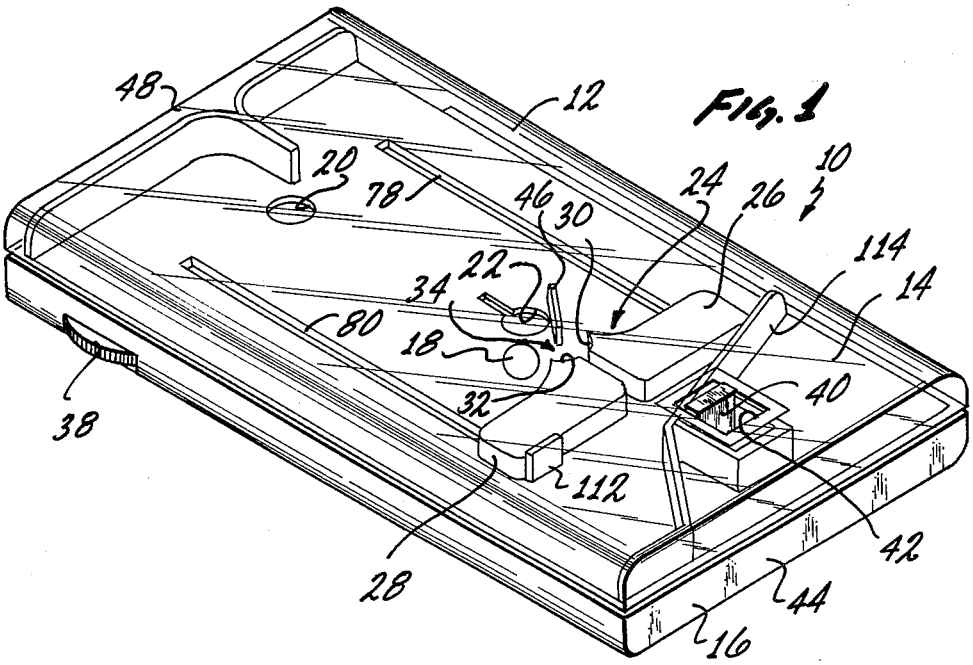
FIG. 1 is an oblique view of the preferred embodiment of the invention.

The invention described in the specification and shown in the drawings, attached hereto, employs certain principles and/or concepts as are set forth and are claimed in the claims appended to this specification. Those skilled in the toy arts will realize that these principles and/or concepts are capable of being used in a variety of embodiments differing from the exact embodiment depicted herein for illustrative purpose. For this reason, this invention is to be construed only in light of the claims and is not to be construed as being limited to only the exact embodiment herein depicted.

DETAILED DESCRIPTION OF THE INVENTION

Figure 2:
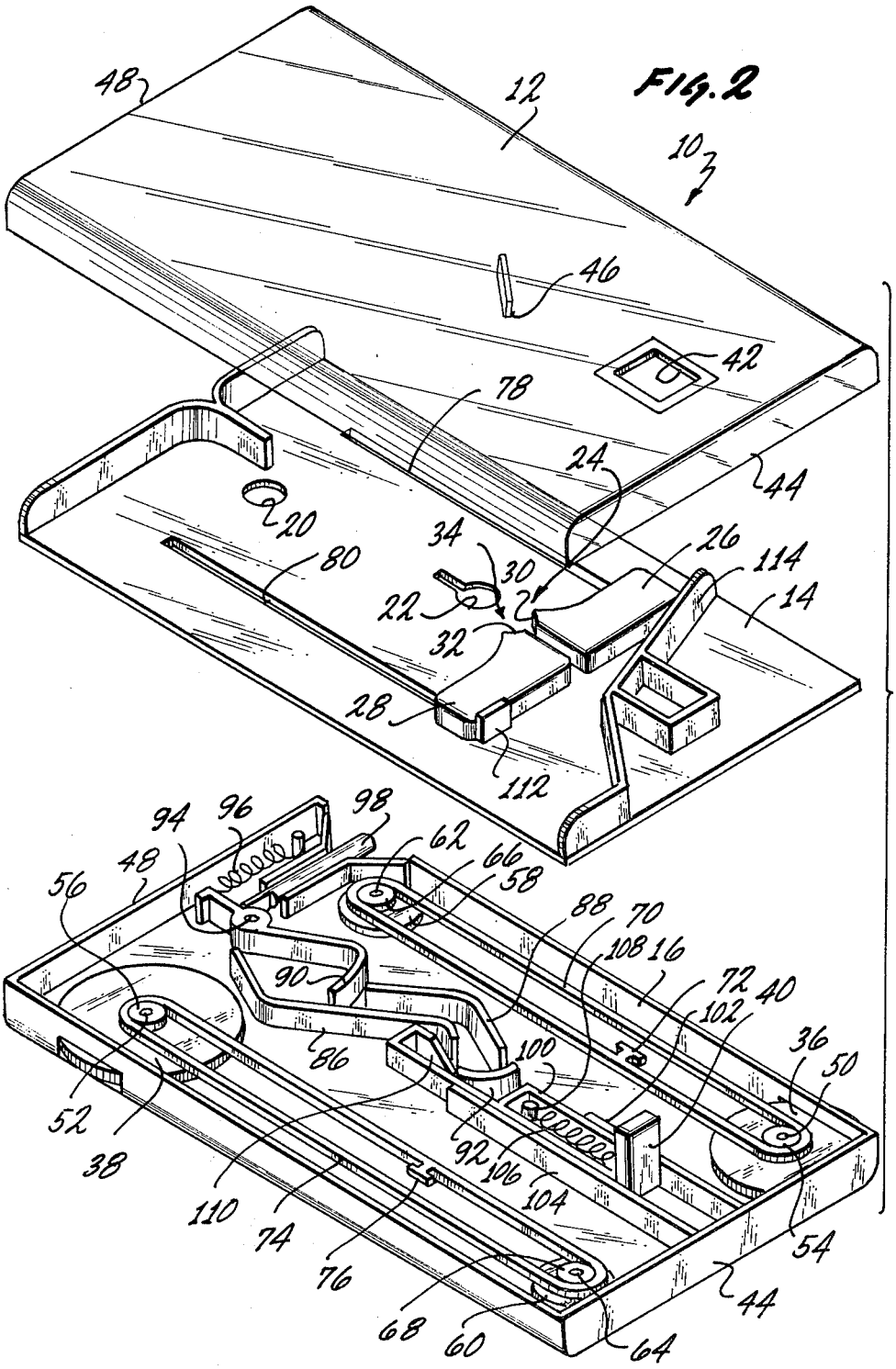
FIG. 2 is an exploded oblique view of the invention shown in FIG. 1.

The toy 10 of the invention is shown in FIG. 1 as it would appear for use. FIG. 2 shows this toy in exploded view. It can be seen in FIG. 2 that the toy 10 includes a clear plastic top housing 12, a central playing surface 14 and a bottom housing 16. The playing surface 14 is located between the top housing 12 and the bottom housing 16. The area between the underside of the top housing 12 and the playing surface 14 is sized to allow movement of objects, collectively identified by the numeral 18 and other components hereinafter identified over the playing surface 14.

Located on the playing surface 14 is a target hole 20. Also located on the playing surface 14 is a launch hole 22. A compound object moving means collectively identified by the numeral 24 incudes a right section 26 and a left section 28. The right section 26 has a curved area 30 and the left section 28 has a curved area 32 which in conjunction with each other form an object depository area 34. The object depository area 34 is only formed when the sections 26 and 28 are aligned in a coordinated position as per their positions in FIGS. 1 and 2.

Located on the lower right hand corner of the bottom housing 16 is a knurled knob 36 and located on the upper left hand side of the bottom housing 16 is a second knurled knob 38. Knurled knob 36 controls the movement of right section 26 as hereinafter explained and knurled knob 38 likewise controls the movement of left section 28. Projecting out of the top housing 12 is a launching button 40. The top housing 12 includes an elongated slot 42 from which the launch button 40 projects. The elongated slot 42 is shaped such that the launch button 40 can be moved backward and forward along the longitudinal axis of the toy 10.

The toy works as follows. The launch button 40 is pulled backwards toward end 44 of the game 10. This causes one of the objects 18 to be expelled out of launch hole 22. However, prior to the launching of the object 18 out of the launch hole 22, the left and right sections 28 and 26 respectively, are aligned near end 44 of the game in the manner in FIG. 1. When the object 18 exits out of the launch hole 22, it strikes baffle 46 and becomes located within the object depository area 34. The player of the game now manipulates the knurled knobs 36 and 38 to attempt to move the left and right sections 28 and 26 in a coordinated manner, maintain them in the coordinated position with respect to each other, toward the other end 48 of the toy 10. As long as the left and right sections 28 and 26 are maintained together in a coordinated manner the object 18 will remain in the object depository area. If and when the sections are successfully moved toward end 48 with the object 18 still resting in the object depository area 34, the object 18 will become located over target hole 20 and will fall through the playing surface 14 into target hole 20. The left and right sections 28 and 26 are then moved back down on toward end 44 and a second object 18 is launched via the launch button 40 through the launch hole 22 and play resumes.

If during movement of the left and right sections 28 and 26 toward end 48 they are not moved in a coordinated manner, one or the other of these sections will move ahead of the other one. When this happens, the object depository area 34 is destroyed and it will no longer successfully maintain the object 18 within it. When this happens, the object 18 is now free to roll out of the object depository area and descend down the playing surface 14 toward end 44 putting it out of play and detracting from the possible number of objects which the player can possibly locate within the target hole 20.

Figure 3:
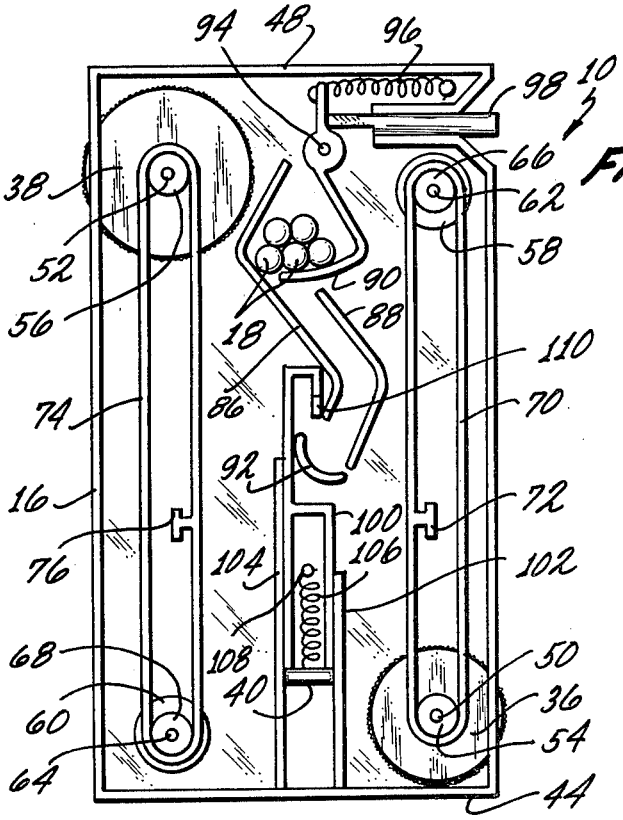
FIG. 3 is a top plan view of the lower portion shown in FIG. 2.
Figure 4:
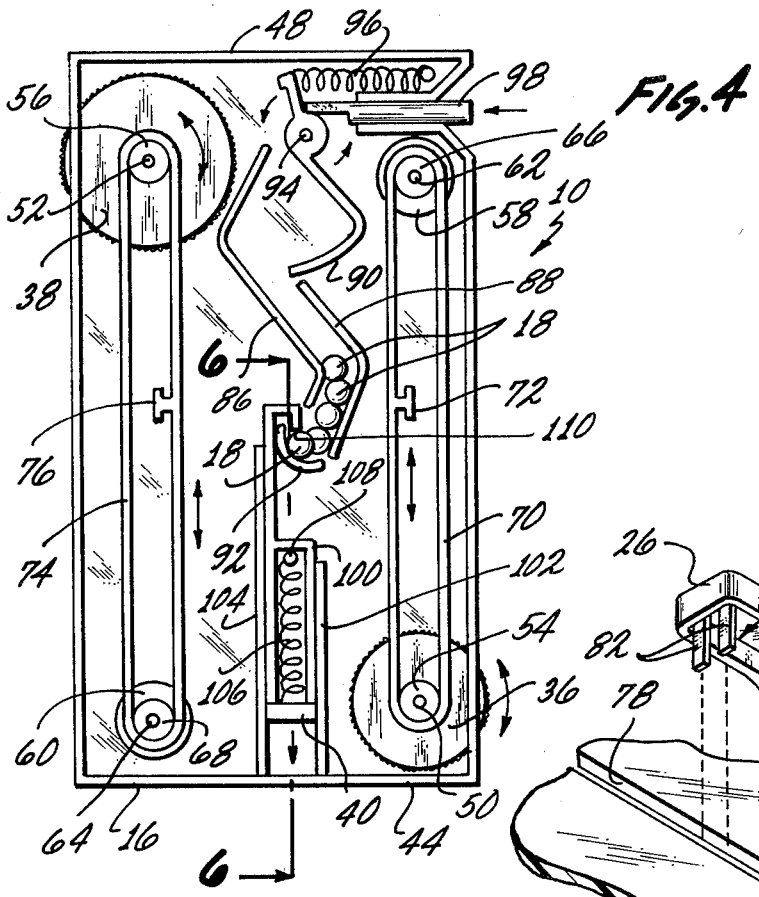
FIG. 4 is a top plan view similar to FIG. 3 except showing certain components shown in FIG. 3 in a different special relationship with respect to one another.
Figure 5:
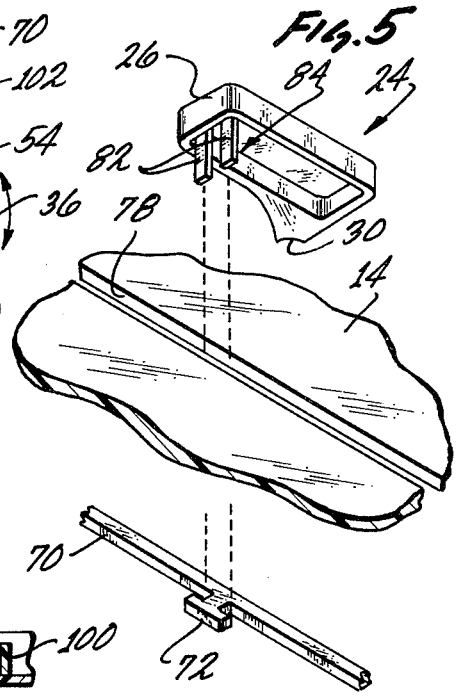
FIG. 5 is an exploded view of a portion of the central component shown in FIG. 2.

The machanism of the game works as follows. As can be seen in FIGS. 2, 3 and 4 each of the knurled knobs 36 and 38 respectively, are mounted on upstanding bosses 50 and 52 respectively, projecting upwardly from the bottom housing 16. The knurled knobs 36 and 38 are free to rotate about bosses 50 and 52. Each of the knurled knobs 36 and 38 include a raised circular surface 54 and 56 respectively located thereon. On the same side of bottom housing 16, but at the opposite end of the toy 10, wherein knurled knobs 36 and 38 are located, are wheels 58 and 60 respectively. These are appropriately mounted so that they can freely rotate about bosses 62 and 64 respectively. Wheel 58 has a raised circular surface 66 located thereon and likewise wheel 60 has a raised circular surface 68 located thereon. Extending between the circular surface 54 on knurled knob 36 and the circular surface 66 on wheel 58 is a continuous belt 70 having a T-shaped projection located toward the center of the loop of the belt 70. Likewise extending between the circular surface 68 on knurled knobs 38 and the circular surface 68 on wheel 60 is a second belt 74 also having a T-shaped projection 76.

Extending longitudinally through the playing surface 14 are elongated slots 78 and 80. These elongated slots are positioned directly over the side of belts 70 and 74 wherein T-shaped projections 72 and 76 are located. Extending downwardly from the bottom of left section 28 are forks collectively identified by the numeral 82. Likewise the right section 26 includes identical forks which are not seen nor numbered in the figures. The forks 84 project through the elongated slot 80 and fit around and are fictionally maintained on T-shaped projection 76. This locks the movement of left section 28 to the movement of belt 74. The belt 74 will move in response to rotation of knurled knob 38. The rotation of the belt 74 is transferred via the forks 82 to the left section 28. The right section 26 is moved in an analogous manner.

Both the left and right sections 28 and 26 are thus easily moved along the elongated slots 78 and 80 by movement of the knurled knobs 36 and 38. Further, because of the presence of the two forks 82 which fit into the elongated slot 80, the left section 28 is prevented from rotating about either of the forks 82 thus will move up and down the playing surface 14 in a position such that its bottom edge 84 is always maintained perpendicular to the elongated slot 80. Likewise, the right section 26 is maintained in a fixed relationship with regard to rotation about its forks. In playing the game it can be seen by viewing FIG. 4 that to move the left section 28 upwardly toward end 48, the knurled knob 38 must be moved in a counterclockwise manner. However, contrary to this, to move the right section 26 toward the end 48, the knurled knob 36 must be moved in a clockwise manner. This requires a little thinking on the part of the players in order to coordinate the movement of the left and right sections 28 and 26. To move both of the sections upwardly toward end 48 in a coordinated manner or in their coordinated position with respect to one another, the player of the game must simultaneously rotate the left knurled knob 36 one direction and the right knurled knob 38 in the opposite direction. To further complicate the movement of the left and right sections, it can be seen from FIGS. 3 and 4 that the right knurled knob 36 is of a smaller diameter than the left knurled knob 38. Only the outside edge of the knurled knobs 36 and 38 are exposed outside of the bottom housing 16 for manipulation by the player-of-the-game's fingers. Since the player of the game is only moving the outside circumference of these knurled knobs 36 and 38, the knurled knob 38 must be rotated at a different rate than the knurled knob 36 in order to coordinate movement of the two sections 26 and 28.

A series of baffles are located on bottom housing 16. These baffles including upstanding baffle 86, upstanding baffle 88, movable baffle 90 and arcuate baffle 92. Movable baffle 90 is pivotly mounted about boss 94. A spring 96 biases movable baffle 90 to the position as is shown in FIG. 3. A reset button 98 projects out of the right hand side of the bottom housing 16 and abutts against movable baffle 90. When the reset button 98 is pressed inwardly toward the center of the toy 10, the movable baffle 90 is rotated about boss 94 in a manner stretching spring 96. When the reset button 98 is released, the movable baffle 90 is rotated from the position shown in FIG. 4, back into the position shown in FIG. 3 under the bias of spring 96.

When the movable baffle 90 is in the position shown in FIG. 3, the objects 18 which are successfully located into and fall through target hole 20, are retained against movable baffle 90 and a portion of baffle 86. After all the objects have been played as hereinafter described, the reset button 98 is depressed inwardly causing movable baffle 90 to rotate to the position shown in FIG. 4 releasing the objects 18 accumulated behind it such that they can roll down the channel formed by baffles 86 and 88 to the position shown in FIG. 4. The leading object 18 abuts against arcuate baffle 92. The object 18, which is abutted against baffle 92, is now in position to be ejected out of launch hole 22.

Figure 6:
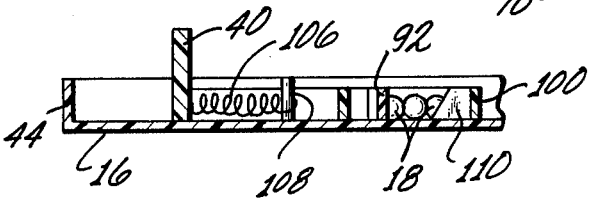
FIG. 6 is a side elevational view in section about the lines 6—6 of FIG. 4.
Figure 7:
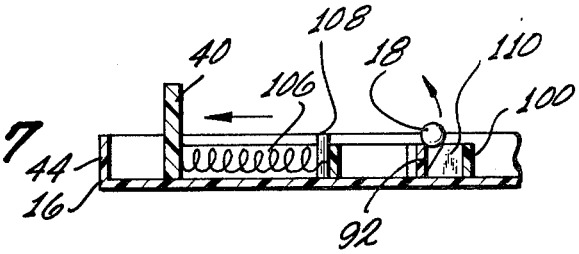
FIG. 7 is a side elevational view of the same components shown in FIG. 6 except certain of these components are shown in a different special relationship with respect to one another.

A slidable member 100 is slidably mounted on bottom housing 16. It slides between baffles 102 and 104 along the longitudinal axis of the toy 10. The launch button 40 is integrally formed as a part of the slidable member 100. Movement of the launch button 40 is therefore communicated to the sliding member 100 causing it to slide between the baffles 102 and 104. A spring 106 attached to the end of launch button 40 located within the interior of toy 10. The other end of the spring 106 is attached to post 108 which projects upwardly from the bottom housing 16. As seen in FIGS. 6 and 7, when the launch button 40 is slid to the right in FIG. 6, it pulls the sliding member 100 with it and stretches the spring 106. When the launch button 40 is released, the spring 106 returns the launch button and the slidable member 100 to the position shown in FIGS. 3 and 6. The slidable member 100 includes a wedge shaped area 110 formed as an integral part thereof. The wedged area 110 in conjunction with baffle 92, will cause any object 18 located next to baffle 92, to be lifted up along the surface of the wedge upwardly and out of the launch hole 22. This movement is shown in FIG. 7.

Projecting upwardly from the top of playing surface 14 is a post 112 which limits the movement of the left section 28 towards end 44. On the right side of the playing surface 14 is baffle 114 which serves the same function for the right side section 26 as well as serves as a directing baffle to displace any objects 18 which are displaced out of the depository area 34 downwardly toward the left side of the playing surface near end 44. The baffle 114 passes in front of the launch button 40 and then curves at a sharper angle toward the end 44 as is evident in FIG. 1. During play of the game, if an object 18 is lost out of the object depository area 34, it will eventually slide along baffle 114 and become lodged in the out or dead area near the end 44.

The baffle 46 which directs the objects 18 from the launch hole 22 into the depository area 34, is formed as a projection from the inside of the top housing 12. It only projects a portion of the distance between the top housing 12 and the playing surface 14 such that the right section 26 is free to move underneath it. The objects 18 however, since they are spherical, have a slightly greater height than the left and right sections 28 and 26 and are therefore caught by the baffle 46 and can be appropriately directed toward the object depository area 34 upon their being moved out of launch hole 22.

We claim:

1. A toy which comprises:

a housing;

at least one object movably located on said housing;

an object moving means located on said housing, said object moving means having at least two sections;

elongated guide means located on said housing, each of said sections operatively associated with said guide means, said sections movable with respect to each other along said guide means and each of said sections independently linearly movable with respect to said housing, said guide means being formed so that said sections can only be moved along parallel paths;

means located on said housing for independently moving each of said sections of said object moving means on said housing;

said sections having a cooperative position with respect to each other and said sections being linearly movable on said housing in said cooperative position by coordinating the independent linear movement of said sections with respect to one another, said object moving means capable of moving said object on said housing from a first point to a second point when said two sections are in said cooperative position and said object is in simultaneous association with both of said sections and said sections are maintained in said cooperative position by coordinating said independent movement of said sections with respect to one another.

2. The toy of claim 1 including:

a playing surface on said housing;

said sections located on said playing surface and slidably movable over said playing surface, said sections capable of moving said object when in said cooperative positions from a first position on said playing surface to a second position on said playing surface.

3. The toy of claim 2 including:

target means located at said second position on said playing surface.

4. The toy of claim 3 including:

a plurality of objects, each of said plurality of objects capable of being independently moved by said object moving means from said first position to said target means and capable of interacting with said target means.

5. The toy of claim 4 wherein:

said target means comprises a first opening in said surface.

6. A toy which comprises:

a housing;

at least one object moving means located on said housing, said object moving means having at least two sections, said sections movable with respect to each other and each independently movable with respect to said housing;

means located on said housing for independently moving each of said sections of said object moving means on said housing;

said sections having a cooperative position with respect to each other and said sections being movable on said housing in said cooperative position by coordinating the independent movement of said sections with respect to one another, said object moving means capable of moving said object on said housing from a first point to a second point when said sections are in said cooperative position and said object is in simultaneous association with both of said sections and said sections are maintained in said cooperative position by coordinating said independent movement of said sections with respect to one another;

a playing surface on said housing;

said sections located on said playing surface and slidably movable over said playing surface, said sections capable of moving said object when in said cooperative position from a first position on said playing surface to a second position on said playing surface;

said means located in said housing for independently moving each of said sections further comprising a first and second belt means located in said housing beneath said playing surface, a first and second belt mounting means located in said housing and said connecting means;

said first and said second belt means movably mounted on said first and said second belt mounting means, respectively, said connecting means connecting said first and said second sections to said first and said second belt means, respectively such that said first and said second sections are movable with respect to movement of said first and said second belt means, respectively.

7. The toy of claim 6 wherein:

said first and said second belt mounting means include a first and a second knurled knob each rotatively mounted in said housing and each having a portion thereof exposed outside of said housing in a position such that each of said knurled knobs can be rotated by a user of the toy.

8. The toy of claim 7 wherein:

said first knurled knob has a diameter different than the diameter of said second knurled knob.

9. A toy which comprises:

a housing;

at least one object movably located on said housing;

an object moving means located on said housing, said object moving means having at least two sections, said sections movable with respect to each other and each independently movable with respect to said housing;

means located on said housing for independently moving each of said sections of said object moving means on said housing;

said sections having a cooperative position with respect to each other and said sections being movable on said housing in said cooperative position by coordinating the independent movement of said sections with respect to one another, said object moving means capable of moving said object on said housing from a first point to a second point when said sections are in said cooperative position and said object is in simultaneous association with both of said sections and said sections are maintained in said cooperative position by coordinating said independent movement of said sections with respect to one another;

a playing surface located on said housing;

said sections located on said playing surface and slidably movable over said playing surface, said sections capable of moving said object when in said cooperative positions from a first position on said playing surface to a second position on said playing surface;

target means located at said second position on said playing surface;

a plurality of objects, each of said plurality of objects capable of being independently moved by said object moving means from said first position to said target means and capable of interacting with said target means;

said target means comprises a first opening in said surface;

an object storage means;

an object launching means;

a second opening in said playing surface at said second position;

said storage means operatively connected to both said first and said second openings, said objects capable of passing through said first opening into said storage means, said object launching means capable of moving one of said objects from said object storage means through said second opening onto said playing surface.

10. The toy of claim 9 wherein:

said means located in said housing for independently moving each of said sections further comprise a first and a second belt means located in said housing beneath said playing surface, a first and a second belt mounting means located in said housing and connecting means;

said first and said second belt means movably mounted on said first and said second belt mounting means respectively, said connecting means connecting said first and said second sections to said first and said second belt means respectively such that said first and said second sections are movable with respect to said first and said second belt means respectively.

11. The toy of claim 10 wherein:

said first and said second belt mounting means include a first and a second knurled knob each rotatively mounted in said housing and each having a portion thereof exposed outside of said housing in a position such that each of said knurled knobs can be rotated by a user of the toy.

* * * * *